US008409037B2

(12) United States Patent
Imatoh

(10) Patent No.: US 8,409,037 B2
(45) Date of Patent: Apr. 2, 2013

(54) TRAINING INSTRUMENT FOR SPORTS

(75) Inventor: Yasuyuki Imatoh, Shiojiri (JP)

(73) Assignee: IBA Co., Ltd., Shiojiri-shi (JP)

( * ) Notice: Subject to any disclaimer, the term of this patent is extended or adjusted under 35 U.S.C. 154(b) by 117 days.

(21) Appl. No.: 12/975,689

(22) Filed: Dec. 22, 2010

(65) Prior Publication Data

US 2011/0160004 A1 Jun. 30, 2011

(30) Foreign Application Priority Data

Dec. 24, 2009 (JP) ..... 2009-292437
Feb. 10, 2010 (JP) ..... 2010-27765
Jul. 1, 2010 (JP) ..... 2010-150904
Dec. 20, 2010 (JP) ..... 2010-282709

(51) Int. Cl.
*A63B 69/00* (2006.01)

(52) U.S. Cl. ..... 473/457; 473/422

(58) Field of Classification Search ..... 473/422, 473/437, 451, 453, 457, 564, 567, 228, 226; D21/789
See application file for complete search history.

(56) References Cited

U.S. PATENT DOCUMENTS 3,809,397 A * 5/1974 Gruenewald ..... 473/457
4,416,451 A * 11/1983 Solloway ..... 473/457
5,100,148 A * 3/1992 Smith ..... 473/228
5,150,897 A * 9/1992 Wortman ..... 473/567
5,165,683 A * 11/1992 Beutler et al. ..... 473/457
5,207,625 A * 5/1993 White ..... 473/228
5,395,107 A * 3/1995 De Pippo ..... 473/451
5,571,048 A * 11/1996 Kenney ..... 473/228
5,803,838 A * 9/1998 DeMarini et al. ..... 473/437
7,112,152 B1 * 9/2006 Chen ..... 473/457
7,118,490 B2 10/2006 Namba
7,458,900 B1 * 12/2008 Park ..... 473/228
2003/0207719 A1 * 11/2003 Hughes ..... 473/228

FOREIGN PATENT DOCUMENTS

JP 2005-270275 A1 10/2005
JP 3997212 B2 8/2007
JP 3149162 2/2009

* cited by examiner

*Primary Examiner* — Mitra Aryanpour

(74) *Attorney, Agent, or Firm* — Kratz, Quintos & Hanson, LLP

(57) ABSTRACT

A training instrument includes a rigid pipe being provided with engaging striae extending in an axial direction, and having a predetermined inner diameter, leaf-shaped wings each of which is provided with a projection of a cross-sectional shape in accordance with each of the engaging striae, a shaft having an outer diameter smaller than an inner diameter of the pipe and being inserted in the pipe, a stopper being attached to an end of the shaft, and a grip being attached to the shaft.

10 Claims, 19 Drawing Sheets

FIG. 14

| KIND | | L | M | S | SS | G |
|---|---|---|---|---|---|---|
| CORRESPONDING DRAWING | | FIG.1 | FIG.1 | FIG.1 | FIG.8 | FIG.9 |
| SHAFT | LENGTH(mm) | 680 | 530 | 465 | 230 | 660 |
| | DIAMETER (mm) | 12 | 12 | 12 | 12 | 12 |
| | MATERIAL | ALUMINUM STAINLESS | ALUMINUM STAINLESS | ALUMINUM STAINLESS POLYACETAL POLYPROPYLENE NYLON6 | POLYACETAL POLYPROPYLENE NYLON6 | POLYACETAL POLYPROPYLENE NYLON6 |
| GRIP | LENGTH(mm) | 270 | 270 | 170 | 160 | 260 |
| WING (ONE PIECE) | LENGTH × WIDTH(mm) | 635 × 225 | 495 × 185 | 405 × 145 | 180 × 115 | 180 × 115 |
| | THICKNESS (mm) | 1 | 1 | 1 | 1 | 1 |
| PIPE | LENGTH(mm) | 600 | 450 | 375 | 150 | 150 |
| | DIAMETER (mm) | 16 | 16 | 16 | 16 | 16 |
| | MATERIAL | ALUMINUM POLYPROPYLENE NYLON6 | SAME AS ON THE LEFT | SAME AS ON THE LEFT | SAME AS ON THE LEFT | SAME AS ON THE LEFT |
| OVERALL | LENGTH(mm) | 950 | 800 | 635 | 390 | 920 |

TRAINING INSTRUMENT FOR SPORTS

CROSS-REFERENCE TO RELATED APPLICATIONS

This application is based upon and claims the benefits of priority of the prior Japanese Patent Application No. 2009-292437, filed on Dec. 24, 2009, the prior Japanese Patent Application No. 2010-27765, filed on Feb. 10, 2010, the prior Japanese Patent Application No. 2010-150904, filed on Jul. 1, 2010, and the prior Japanese Patent Application No. 2010-282709, filed on Dec. 20, 2010, the entire contents of which are incorporated herein by reference.

BACKGROUND OF THE INVENTION

1. Field of the Invention

The present invention relates to a training instrument. More specifically, the present invention relates to a training instrument in order to make stronger muscles including inner muscle of the arm, shoulder and the like of sportsman.

2. Description of the Related Art

In the related art, a training instrument for improving a golfer's golf swing is disclosed in Japanese Laid-open Patent Publication No. 2005-270275.

The training instrument is formed using a sheet of film flexible enough to wrap cylindrically around a shaft of a commercial golf club.

Four wings are attached to the film at fixed positions so that they can radially spread around the shaft of a commercial golf club.

However, the above training instrument lacks practical use.

When strongly swinging the training instrument for training, a very big air resistance with which the wings are met makes the cylindrical film distort and prevents it from rotating smoothly around the shaft of the golf club.

SUMMARY OF THE INVENTION

It is an object of the present invention to provide a training instrument that is capable of smoothly changing the direction of the wings depending on how the wings are met with air resistance.

According to one aspect discussed herein, there is provided a training instrument including a rigid pipe being provided with engaging striae extending in an axial direction, and having a predetermined inner diameter, leaf-shaped wings each of which is provided with a projection of a cross-sectional shape in accordance with each of the engaging striae, a shaft having an outer diameter smaller than an inner diameter of the pipe and being inserted in the pipe, a stopper being attached to an end of the shaft, and a grip being attached to the shaft.

According to another aspect discussed herein, there is provided a training instrument including a shaft, a grip being attached to the shaft, a rigid holder-attaching pipe in which the shaft is inserted, a first, second, and third wing holders having tubular shapes, in which the holder-attaching pipe is inserted, leaf-shaped wings being attached to the first, second, and third wing holders, respectively, a first stopper of a tubular shape being fixed to the shaft to prevent the holder-attaching pipe from moving to the grip side, a second stopper of a tubular shape, in which the shaft is inserted to be concentric on the first stopper and being capable of being attached to and being detached from the first stopper, a third stopper of a tubular shape being fixed to the shaft and preventing the second stopper from moving to the grip side, and a fourth stopper being attached to an end of the shaft, wherein when the second stopper is fixed to the first stopper, the first and second wing holders are prevented from moving to the grip side, and when the second stopper is released from the first stopper, the second stopper is moved to the third stopper, and then, the first and second wing holders are moved from the holder-attaching pipe on a surface of the first stopper, followed by folding the wings.

BRIEF DESCRIPTION OF THE DRAWINGS

FIG. 14 is a table of materials and sizes of parts of the training instruments according to the embodiments;

DESCRIPTION OF THE PREFERRED EMBODIMENT

Figure 1:
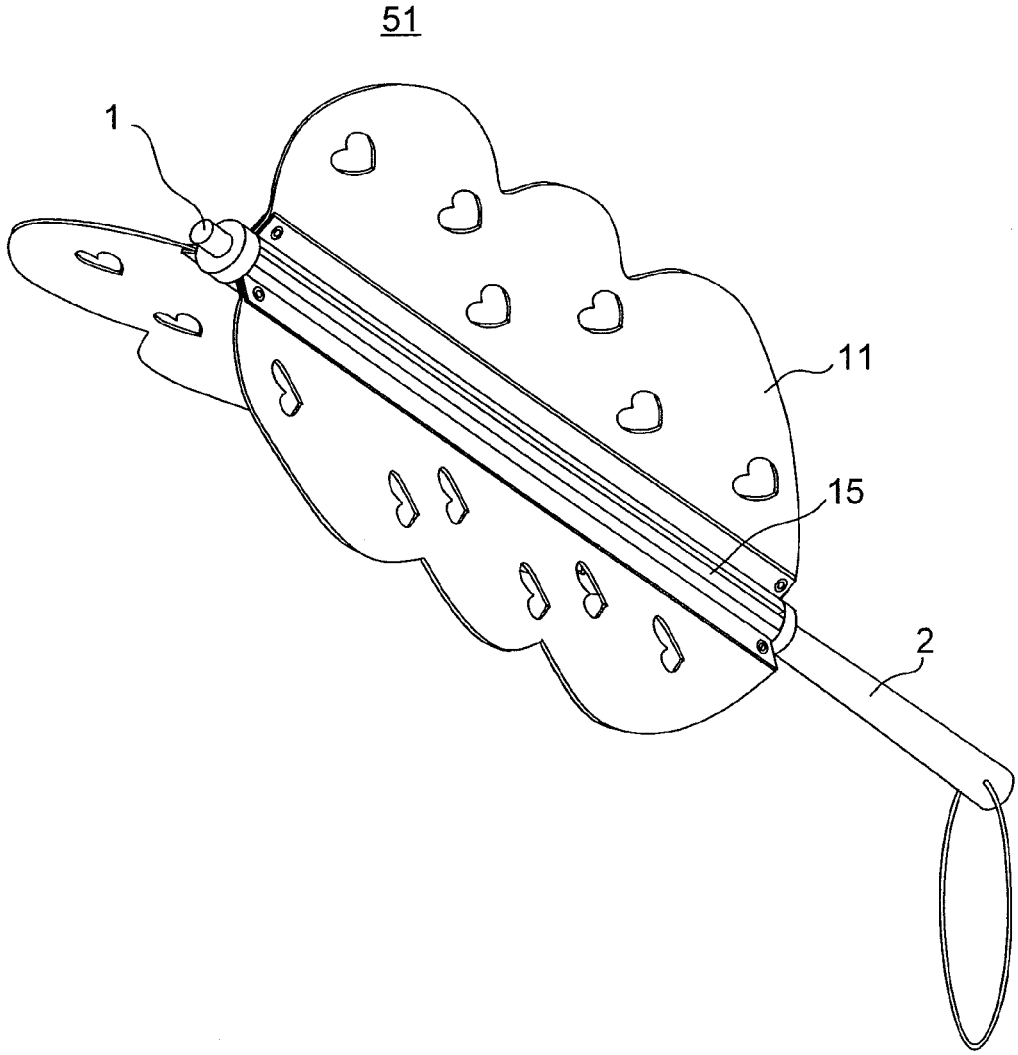
FIG. 1 is a perspective view illustrating a training instrument according to a first embodiment.

In the following, description will be made for the embodiments of the present invention referring to the drawings.

First Embodiment (Description of Training Instrument)

FIG. 1 is a view illustrating the training instrument 51 according to the embodiment of the present invention.

As illustrated in FIG. 1, the training instrument 51 has three wings 11 which are disposed in a radial manner and symmetrically around a shaft 1 with a grip 2. The three wings 11 are attached to a pipe 15 being rotatable around the shaft 1.

Figure 2A:
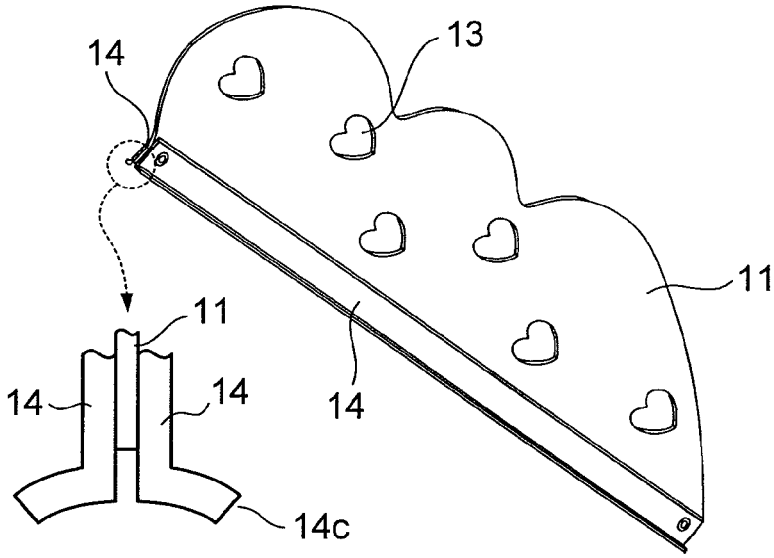
FIG. 2A is a view illustrating a wing of three wings of FIG. 1.
Figure 2B:
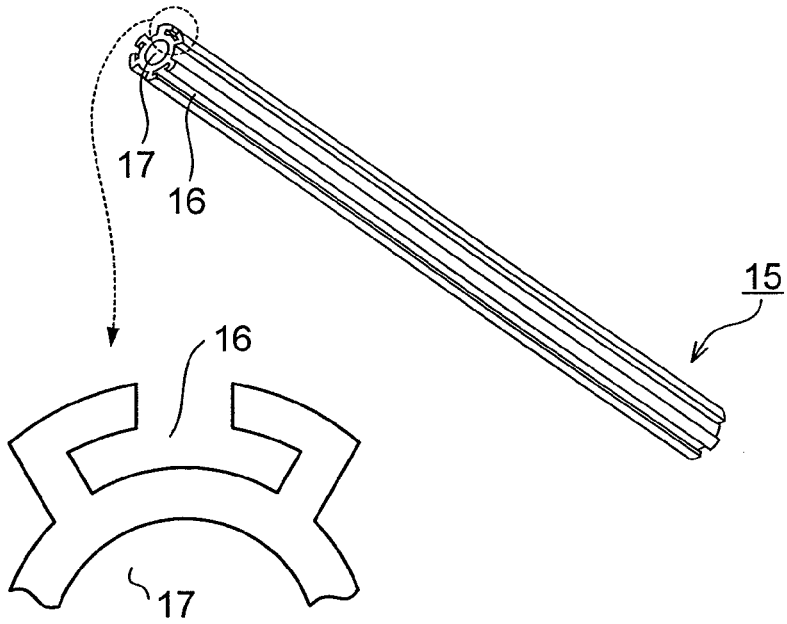
FIG. 2B is a view illustrating a pipe to which the three wings are attached.

FIG. 2A is a view illustrating a wing of the three wings 11 of FIG. 1, and FIG. 2B is a view illustrating the pipe 15 to which the three wings 11 are attached.

The wing 11 has three curved ends as illustrated in a perspective view of FIG. 2A, and is provided at the side end thereof with a pair of plates 14 each having a cross-sectional shape similar to the letter L. The pair of plates 14 are located on opposite sides of the wing 11, and are fixed to the wing 11 with grommets. The side end of the wing 11 has a projection 14*c* of a cross-sectional shape similar to the letter T as illustrated in an enlarged side view of FIG. 2A. Various kinds of plastics can be used as material for the wing 11 and the plate 14.

The pipe 15 is made from a material of high rigidity to support the wings 11. An inner diameter of the pipe 15 is set to be a little larger than an outer diameter of the shaft 1. On a surface of the pipe 15, three engaging striae 16 are formed over an entire length of the pipe 15 in an axial direction thereof and at regular intervals around the pipe 15, as illustrated in a perspective view of FIG. 2B. The engaging striae 16, as illustrated in an enlarged side view of FIG. 2B, have a cross-sectional shape similar to the letter T, which is wider in a lower part than in an upper part.

Figure 3A:
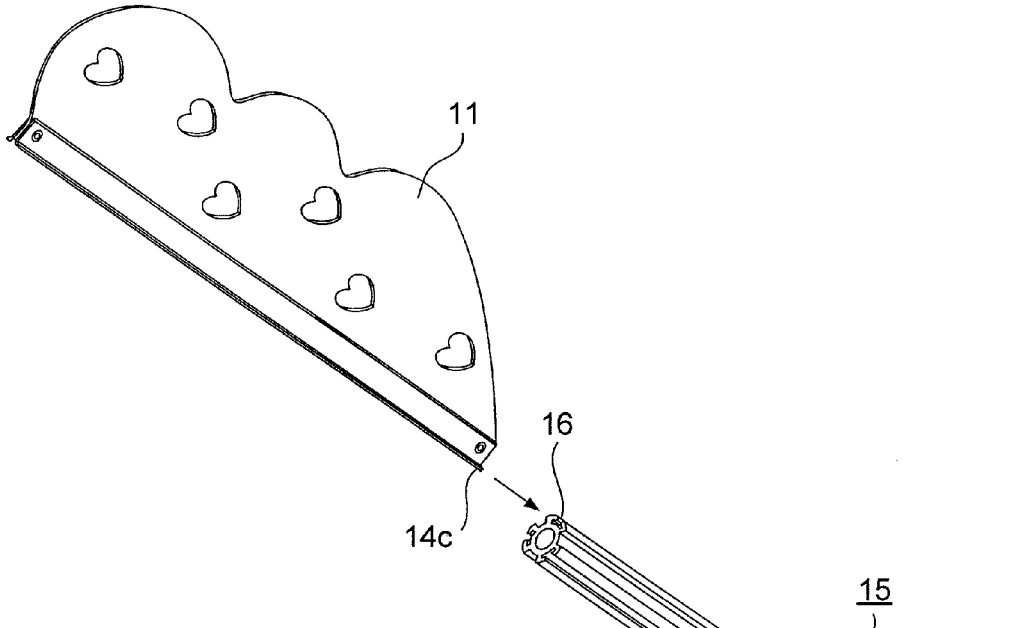
FIGS. 3A to 3C are views illustrating a method of setting up three wings according to the first embodiment of the present invention.
Figure 3B:
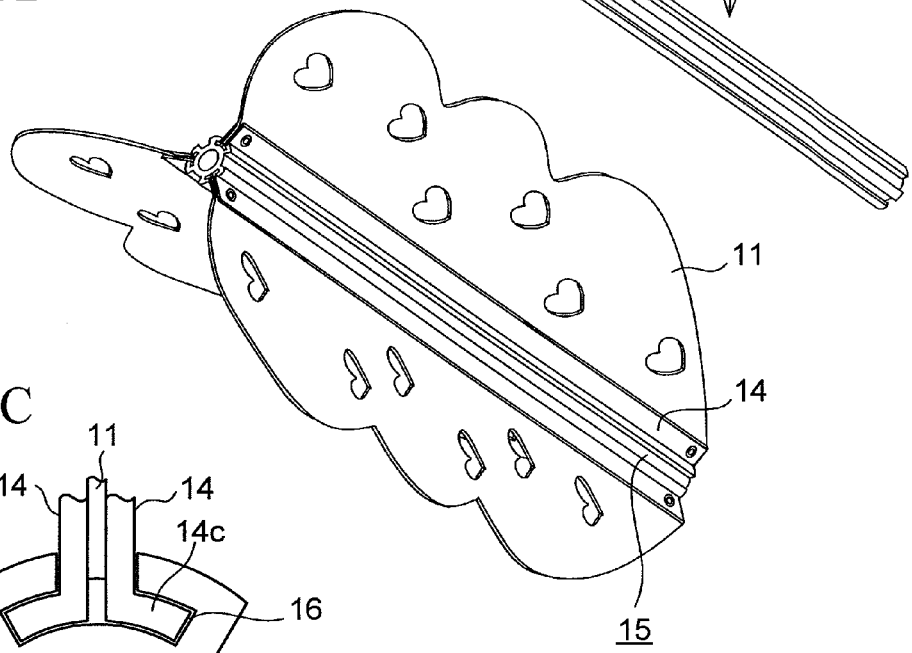
Figure 3C:
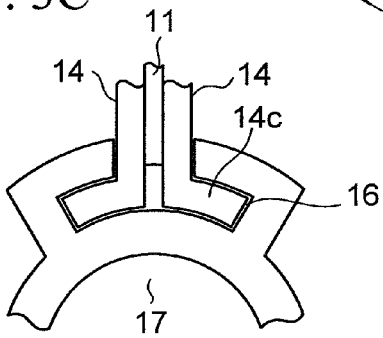

As illustrated in FIGS. 3A and 3B, the wings 11 are attached to the striae 16 of the pipe 15 by inserting the projection 14*c* which is similar to the letter T of the wing 11 into the striae 16 of the pipe 15 from a lateral side. FIG. 3C is an enlarged side view from an axial direction of the pipe 15 after the wings 11 are attached to the pipe 15. Note that the shaft 1 may be inserted in hole 17 of the pipe 15 after the three wings 11 are attached to the pipe 15, or the three wings 11 may be attached to the pipe 15 after the pipe 15 is attached to the shaft 1.

To detach the wings 11 from the pipe 15, after or before the shaft 1 is removed from the pipe 15 with the wings 11, the wings 11 may be slid out from the engaging striae 16 of the pipe 15.

Next, description will be made for the shaft 1 inserted in the pipe 15.

Figure 4A:
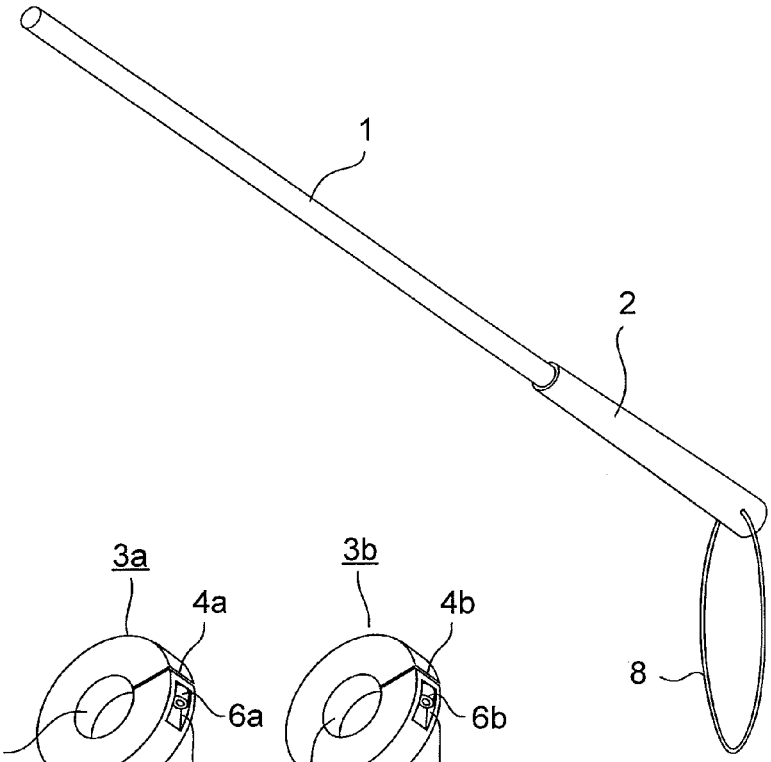
FIG. 4A is a view illustrating a shaft with a grip, to which the pipe is attached.

As illustrated in FIG. 4A, the shaft 1 has a cylindrical shape in which an outer diameter is a little smaller than an inner diameter of the pipe 15, and is constant over the entire length. Accordingly, the pipe 15 can rotate smoothly around the shaft 1. A grip 2 of the shaft 1 is formed in a manner such that the diameter of the grip becomes larger going towards the end. With this, when the shaft 1 is swung in hand, it is less likely that the grip 2 slips out of the hand.

Figure 4B:
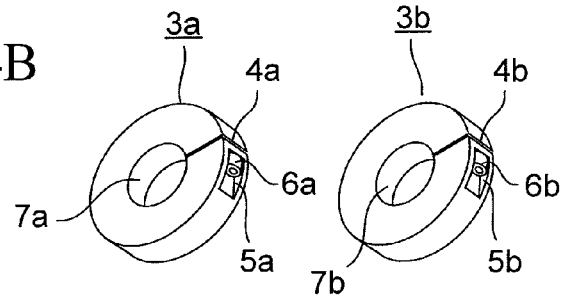
FIG. 4B is a view illustrating an upper stopper and a lower stopper for limiting an axial movement of the wings and FIG. 4C is a view illustrating a state after attaching the lower stopper to the shaft.
Figure 4C:
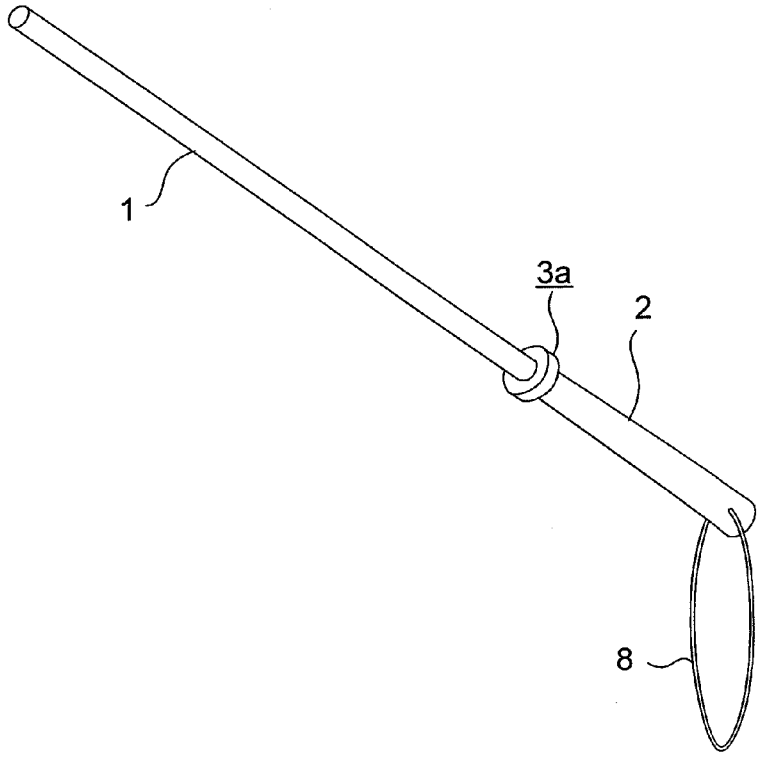

Further, in order to limit a movement of the pipe 15 in both the upper and lower directions while allowing a rotation of the pipe 15 around the shaft 1, stoppers 3*a*, 3*b* of a ring like shape are attached to a lower base portion and an upper end of the shaft 1, respectively. FIG. 4C illustrates a condition attaching the lower stopper 3*a* to the shaft 1. The ring of the stopper 3*a* is separately cut at a portion 4*a* as illustrated in FIG. 4B. It is the same for stopper 3*b*. To fix the stopper 3*a* to the shaft 1, after the shaft 1 is inserted in the central hole 7*a* of the stopper 3*a*, a screw 6*a* is inserted in the screw hole 5*a* and then, it is fastened to narrow down the central hole 7*a*. It is the same for stopper 3*b*.

Further, a strap 8, by wrapping it around a wrist of a trainee at the time of holding the training instrument 51 in his hand, can prevent the training instrument 51 from flying away to the periphery even if the grip 2 slips out of his hand.

As described above, according to the training instrument 51 of the first embodiment of the present invention, the wings 11 and the pipe 15 are engaged with each other by fitting the projection formed in the side end 14*a* of the wing 11 to the striae 16 extending in the axial direction of the pipe 15 of a high rigidity.

Accordingly, when the wings 11 are met with a large air resistance by strongly swinging the training instrument 51, the resistance force is distributed uniformly over the entire length of the striae 16 of the pipe 15, and thus, deformation of the pipe 15 is prevented. Therefore, it is capable of maintaining smooth rotation of the wings 11 around the shaft 1.

(Experiment to Survey a Movement of the Wing)

Figure 5:
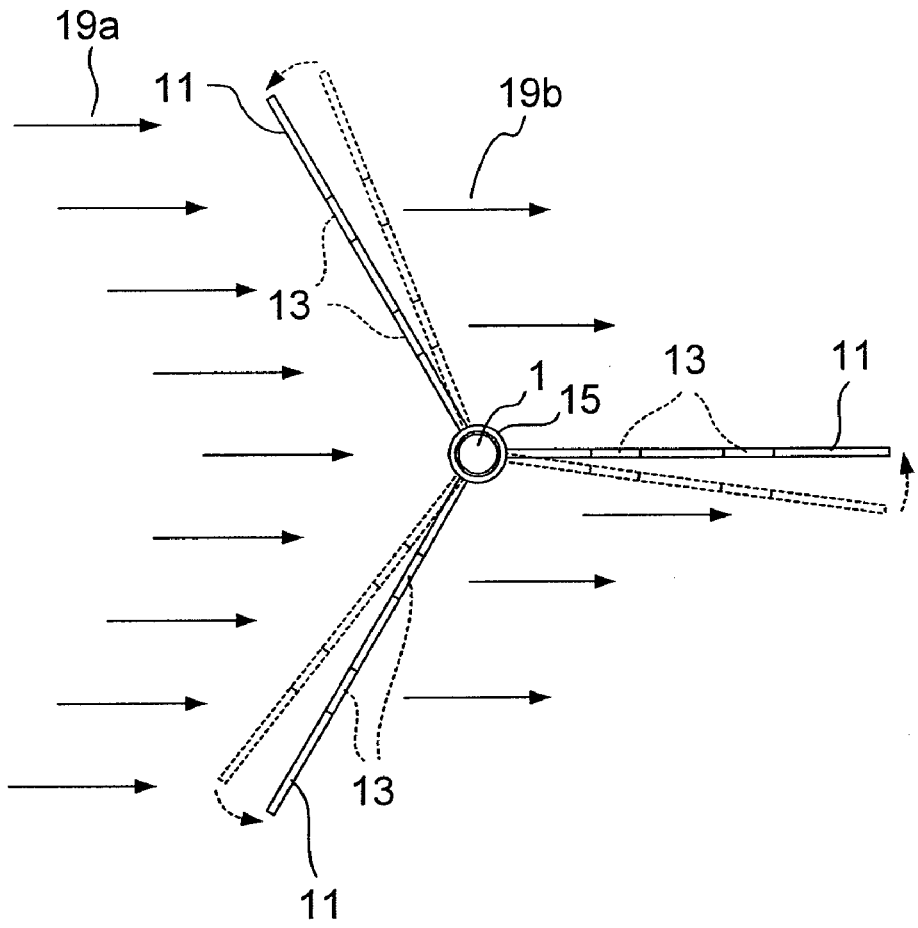
FIG. 5 is a top view illustrating a movement of the wings while simulating the effect of wind to the wings of the training instrument by an electric fan.

FIG. 5 is a view describing a movement of the three wings 11 which are supported by the shaft 1, and a view from an upper part in the axial direction of the shaft 1.

In the experiment, the wind 19*a* is sent to the wings 11 by an electric fan. The three wings 11, at the beginning, are subjected to pressure of the wind 19*a* to rotate a little around the shaft 1. After that, as illustrated by a solid line of FIG. 5, the two wings 11 turned symmetrically with respect to the direction of the wind 19*a* and the other one wing 11 turned just behind the two wings and in the direction corresponding to the direction of the wind 19*a*. Further, when the experiment is continued by changing the direction of the wind, similarly, the two wings 11 turned symmetrically with respect to the direction of the wind 19*a* and the other one wing 11 turned just behind the two wings and in the direction corresponding to the direction of the wind 19*a*.

Such movement of the wings 11 is caused by balancing against the resistance of the wind with which the wings 11 are met. It is considered that the wind 19*b* especially passing through the holes 13 of the wings 11 plays an important role. Specifically, when the wing (back wing) 11, as illustrated by a dashed-line, sways around the direction corresponding to the direction of the wind 19*a*, the wind 19*b* passing through the holes 13 of the wings 11 blows against the back wing 11 to push the back wing 11 back to the direction corresponding to the direction of the wind 19*a*.

As described above, it was confirmed that there was a strong relationship between the direction of the three wings 11 supported by the shaft 1 and the direction of the air flow, and the three wings 11 at all times turned in the fixed directions with respect to the direction of the air flow. Specifically, the two wings 11 turned symmetrically with respect to the direction of the air flow 19*a*, and the other one wing 11 turned just behind the two wings and in the direction corresponding to the direction of the air flow 19*a*.

When practically swinging the training instrument in hand, the wings 11 turned to the direction of a movement of the training instrument at all times during swinging the training instrument.

(Description of Movement of the Wings of the Training Instrument in a Pitching Motion of a Baseball)

Figure 6A:
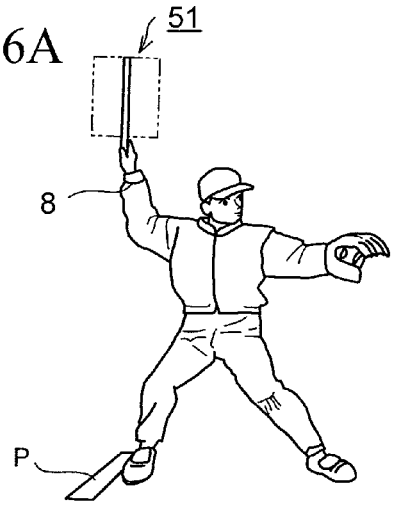
FIGS. 6A and 6B are views illustrating an initial stage and a final stage in a pitching motion of a baseball using the training instrument.
Figure 6B:
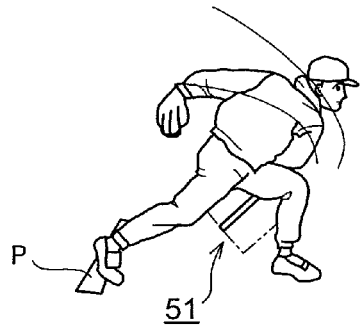

FIGS. 6A and 6B are perspective views illustrating an initial stage and a final stage in the pitching motion using the training instrument 51, respectively.

Figure 7:
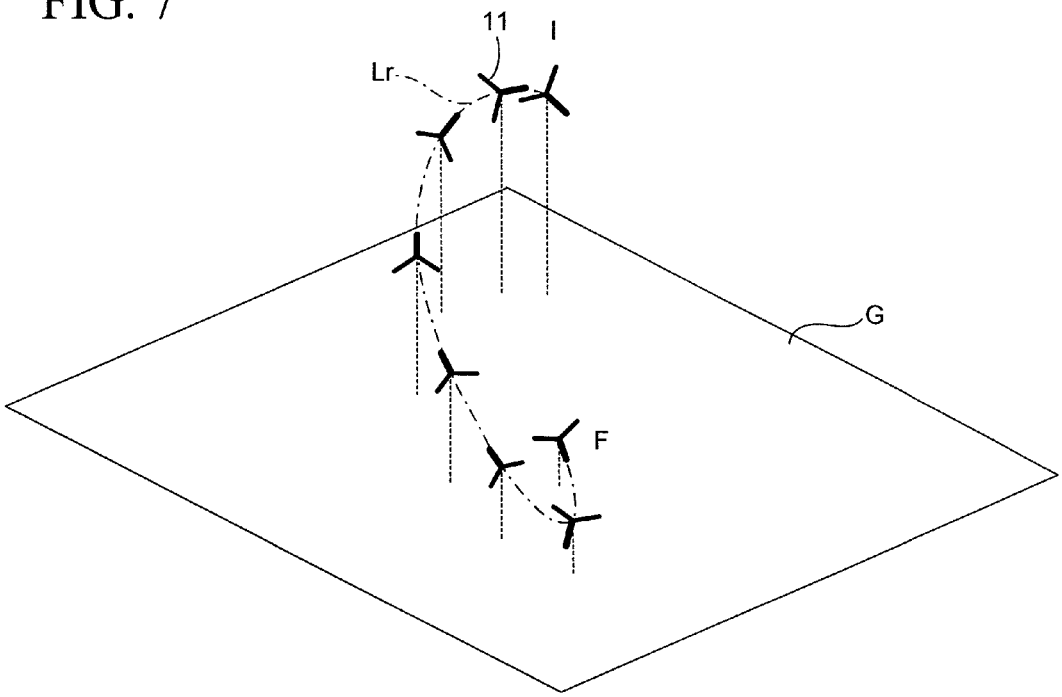
FIG. 7 is a view illustrating directions of the wings of the training instrument at eight points during the pitching motion.

FIG. 7 is a perspective view illustrating directions of the three wings 11 of the training instrument 51 at eight points from the initial stage to the final stage in the pitching motion. A symbol Lr represents a practical trajectory (a chain line) of the three wings 11 in the pitching motion. A symbol I represents the initial stage (FIG. 6A) advancing a little from start of the pitching motion, a symbol F represents the final stage (FIG. 6B) of the pitching motion, and a symbol G represents a ground. Moreover, each of dotted-lines at the eight points represents a height to the wings 11 from the ground G.

Before starting a pitching motion, a grip 2 of the training instrument is held with a dominant hand. In the pitching motion, an arm with the training instrument is swung up, and then, is swung down while turning a body of a trainee.

During the pitching motion, a swinging direction of the arm (in other words, the direction of trajectory (Lr)) is changed at every moment as illustrated in FIG. 7. And, the wings rotate left and right smoothly as an air resistance balances in accordance with the swinging direction of the arm. Thereby, the wings turn at all times in the fixed directions with respect to the swinging direction of the arm. Specifically, the two wings 11 turn symmetrically and the other one wing 11 turns just behind the two wings 11 and in the swinging direction. Therefore, the wings are met with an approximately constant air resistance during swinging the training instrument. Note that magnitude of the air resistance with which the wings are met may be somewhat changed depending on a swing speed of the arm.

In this manner, during swinging the training instrument, the arm and shoulder are loaded with a resistive force (burden) which does not drastically change. Thereby, the muscles including the inner muscles of the arm and shoulder can be developed properly and easily without being injured.

When the pitching motion is performed on the basis of a pitching theory which is developed by the present inventor, so-called Imatoh's pitching theory, the training instrument is more effective.

Various Kinds of Modified Examples from the First Embodiment

First Modified Example

Figure 8:
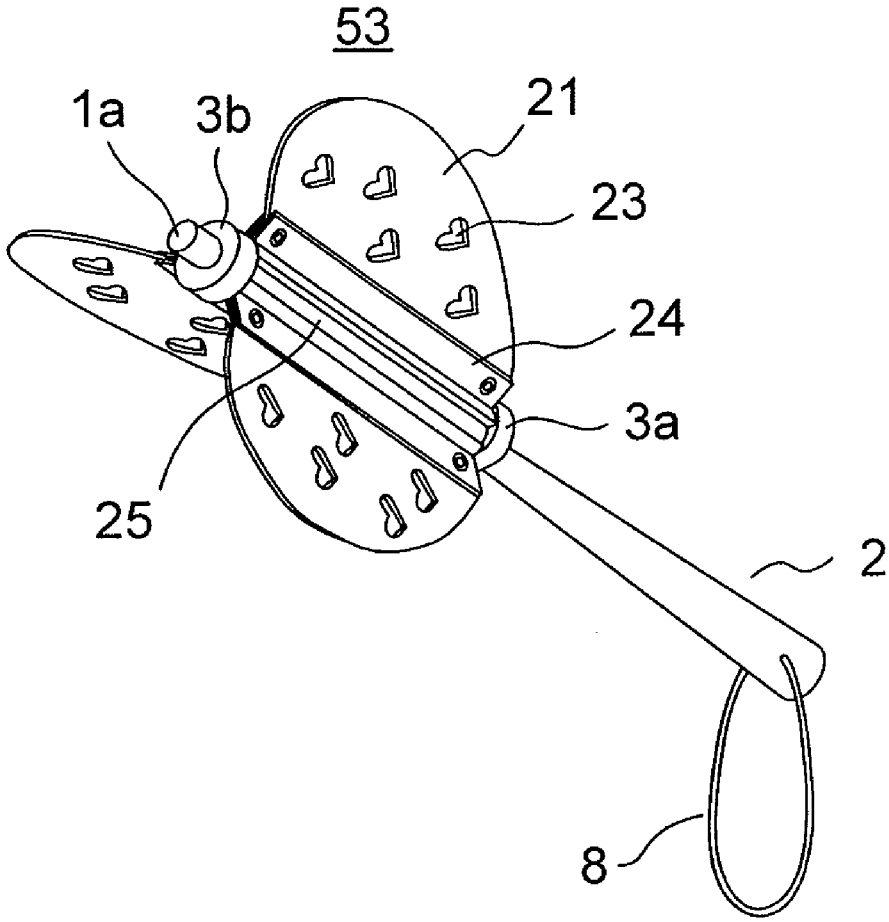
FIG. 8 is a perspective view illustrating a first modified example of the training instrument according to the first embodiment.

FIG. 8 is a perspective view illustrating a training instrument 53 for improvement of health, rehabilitation or the like according to the first modified example.

In the training instrument 53, wings 21 are set to be smaller and a shaft 1*a* is set to be shorter in accordance with the wings 21 in contrast with the aforementioned training instrument 51.

In the training instrument 53, as illustrated in FIG. 8, the three wings 21 are disposed radially and symmetrically around the shaft 1*a* with a grip 2. The three wings 21 are attached to a pipe 25 in such a manner as to be rotatable around the shaft 1*a*.

Note that regarding the other elements, a symbol 23 represents each of the holes formed on the wings 21 to adjust an air resistance, 24 represents each of the elongated plates, which have a cross-sectional view similar to the letter L, respectively, and form a side end of the wing having a cross-sectional view similar to the letter T, 25 is a pipe being provided with engaging striae of a cross-sectional view similar to the letter T on an outer surface of the pipe 25.

The method for setting up the training instrument 53 is the same as the first embodiment.

Second Modified Example

Figure 9:
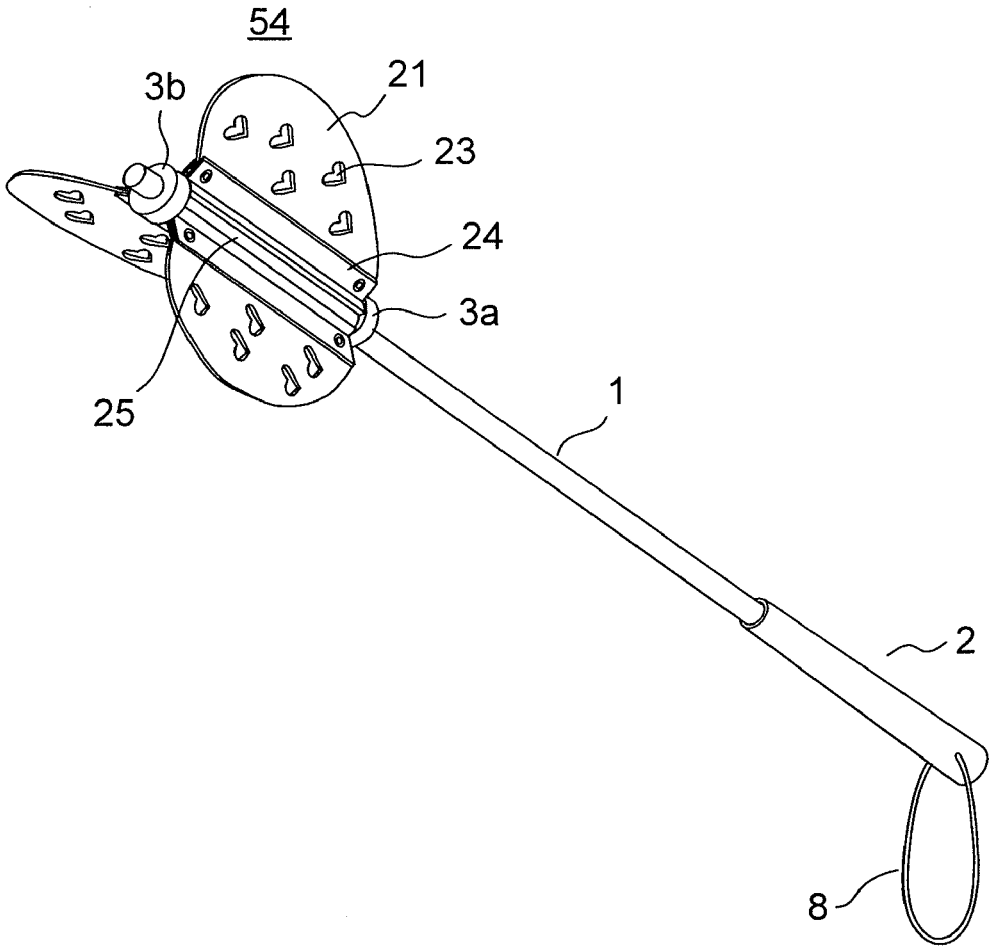
FIG. 9 is a perspective view illustrating a second modified example of the training instrument according to the first embodiment.

FIG. 9 is a perspective view illustrating a training instrument 54 for training of batting or golf swing according to the second modified example.

Different from the first modified example, the shaft is set to be as long as the training instrument 51 of FIG. 1, and the wings 21 are attached to an end side of the shaft 1.

The method for setting up the training instrument 54 is the same as the first embodiment.

Third Modified Example

Figure 10:
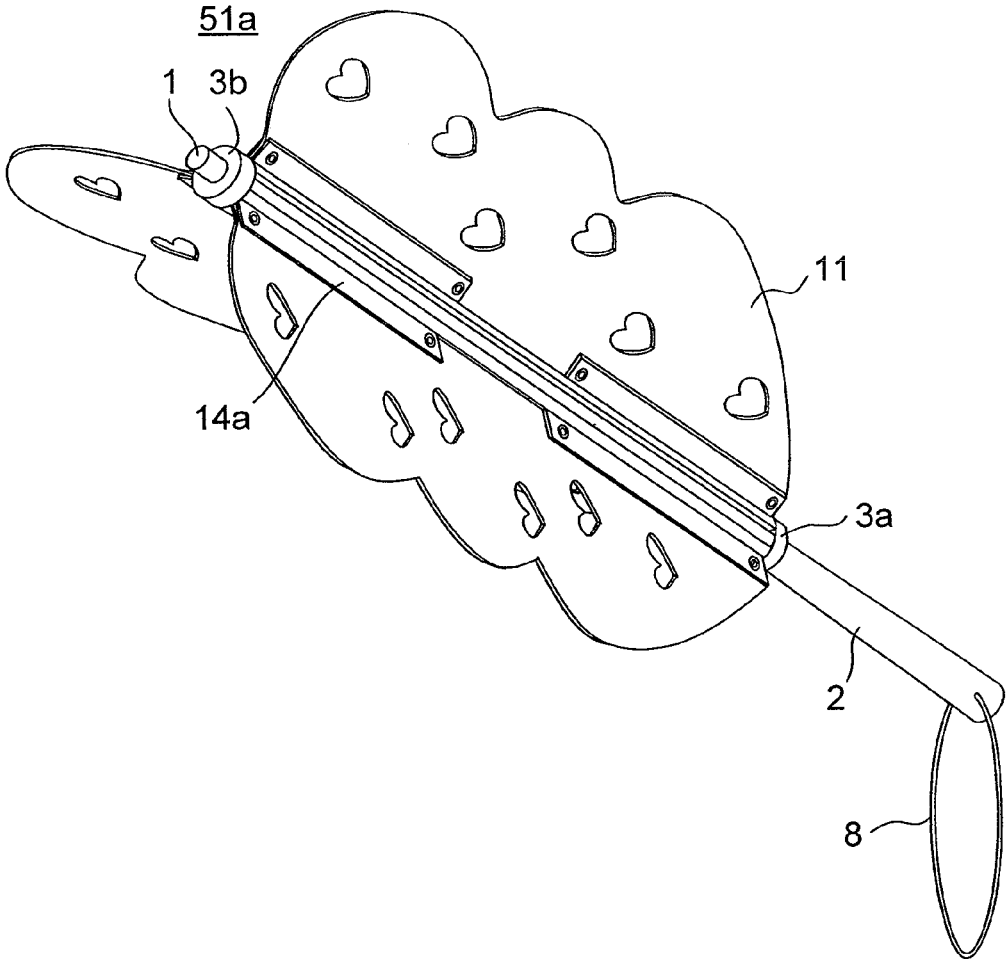
FIG. 10 is a perspective view illustrating a third modified example of the training instrument according to the first embodiment.

FIG. 10 is a perspective view illustrating a training instrument 51*a* according to the third modified example.

In the training instrument 51*a*, different from the training instrument 51 of FIG. 1, two pieces of shortened plates 14*a* of an identical length are used as the plate at the side end of the wing 11. The plates 14*a* are attached to the wing 11 apart from each other.

Fourth Modified Example

Figure 11:
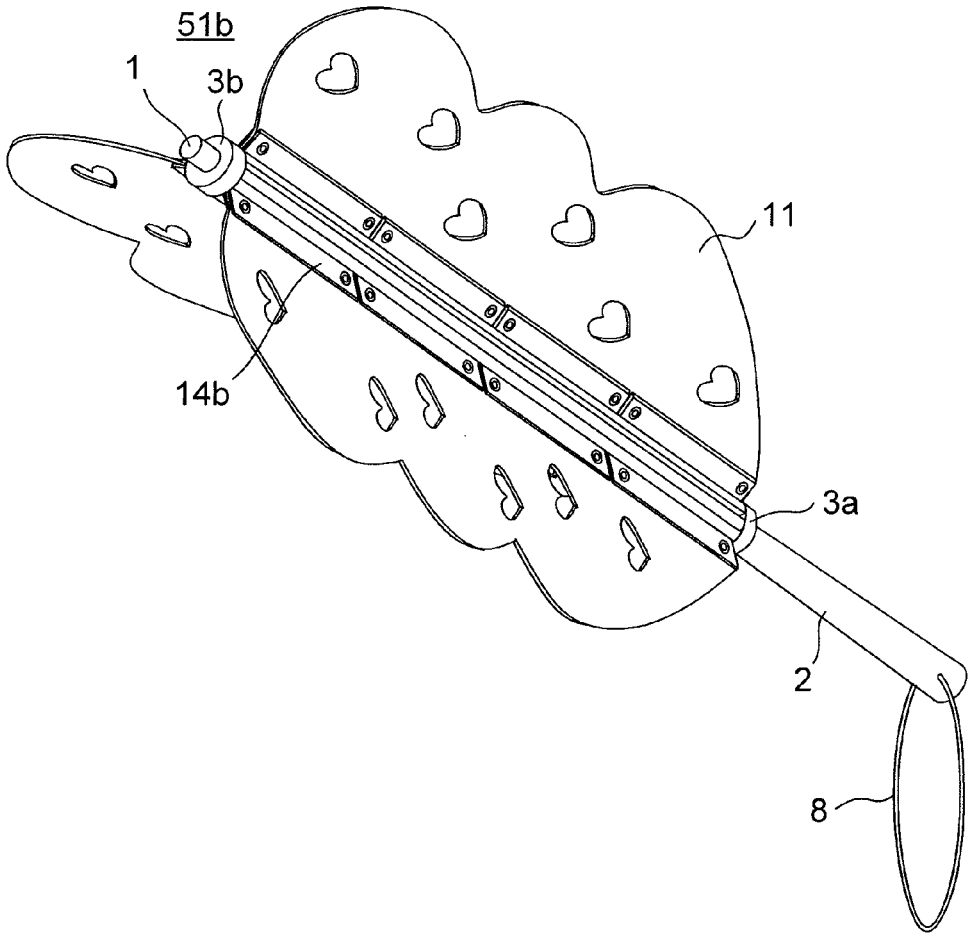
FIG. 11 is a perspective view illustrating a fourth modified example of the training instrument according to a first embodiment.

FIG. 11 is a perspective view illustrating a training instrument 51*b* according to the fourth modified example.

In the training instrument 51*b*, further modifying the third modified example, four pieces of further shortened plates 14*b* of an identical length are used as the plate at the side end of the wing 11. The plates 14*b* are attached to the wing 11 in such a manner so that they are close to each other.

As the aforementioned third and fourth modified examples, by using the shortened plates 14*a* or 14*b* of an identical length, only one kind of plate 14*a* or 14*b* is available for both a long wing and a short wing. In this case, as a wing is longer, more plates can be used.

Note that in the third and fourth modified examples, further, a pipe 15 can be shortened in pieces accompanying with the shortened plate 14*a* or 14*b*.

Second Embodiment

Figure 12A:
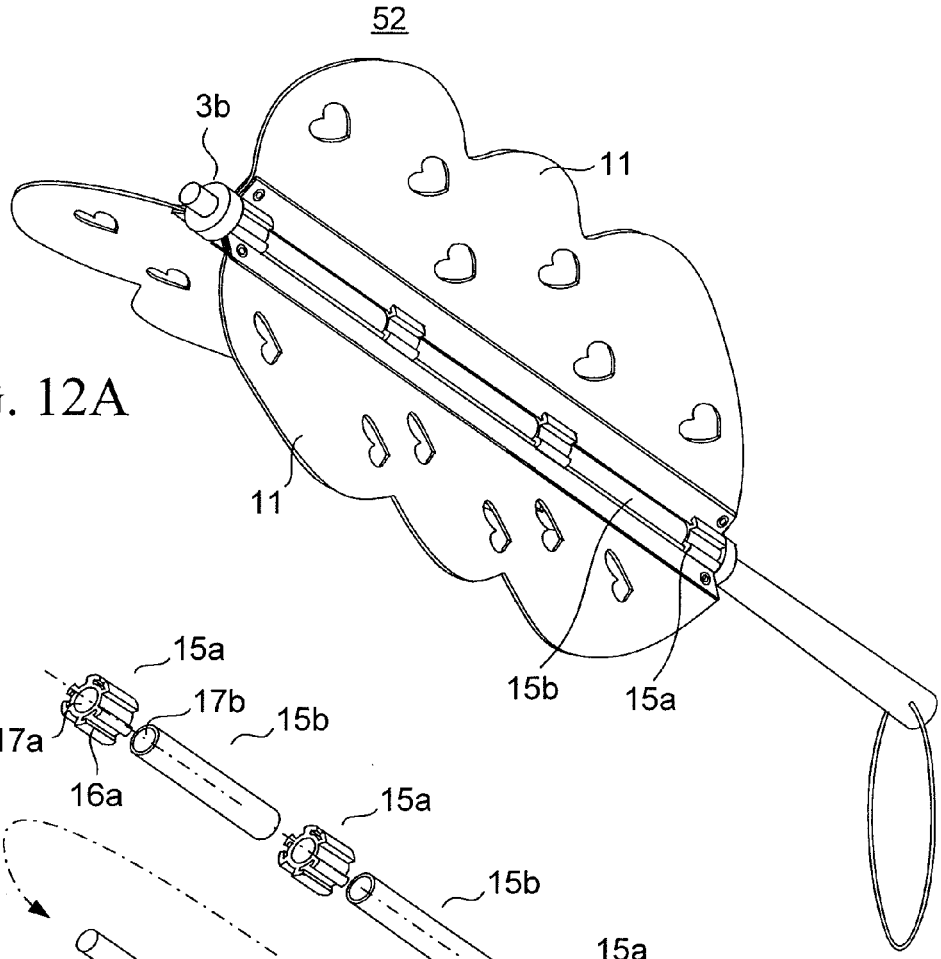
FIG. 12A is a perspective view illustrating a training instrument according to a second embodiment.
Figure 12B:
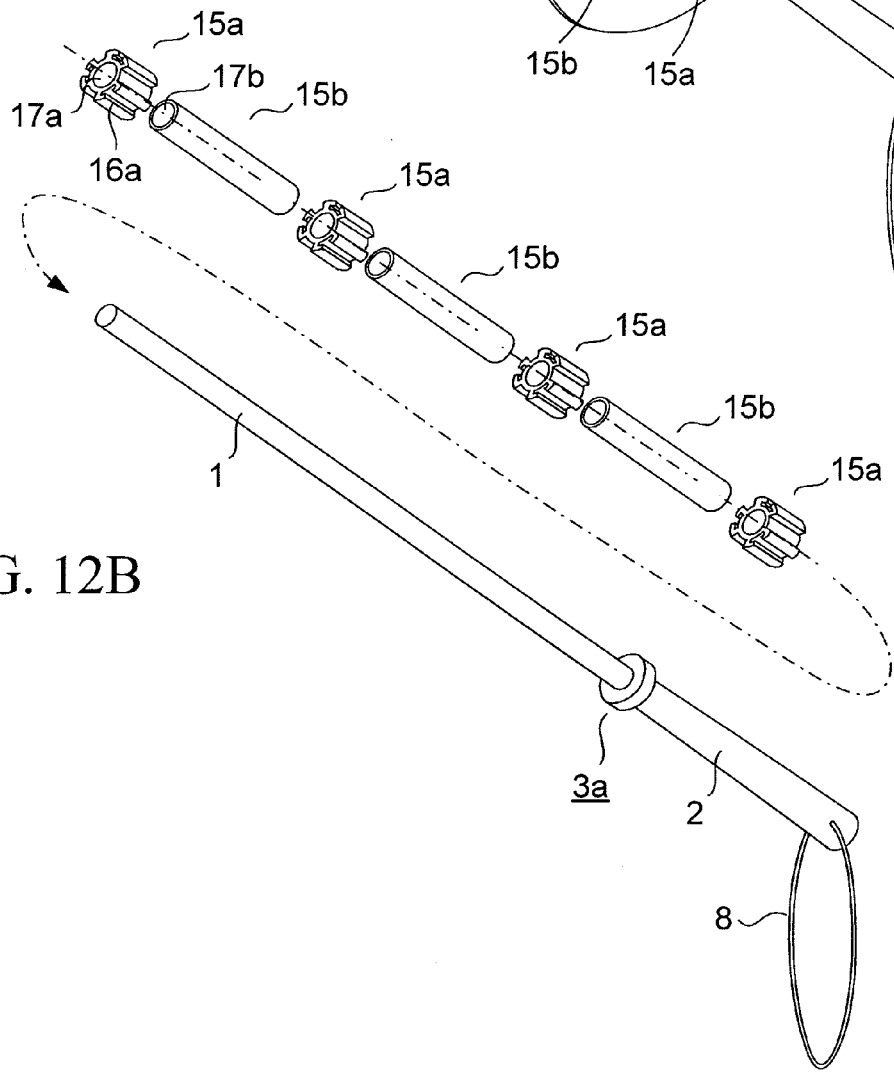
FIG. 12B is a perspective view illustrating a deconstructed view except for the wings of FIG. 12A.

FIG. 12A is a perspective view illustrating the training instrument 52 according to a second embodiment, and FIG. 12B is a perspective view illustrating a deconstructed view except for the wings of FIG. 12A.

The training instrument 52 is different from the training instrument 51 in the following ways. First, the pipe with the engaging striae is separated in four short pipes (first pipe) 15*a*. Second, the first pipes 15*a* are attached to the shaft 1 while at least one pipe (second pipe) 15*b* without any engaging stria is interposed between the first pipes 15*a*. Note that symbols 17*a* and 17*b* in FIG. 12B represent holes of pipes 15*a*, 15*b* in which the shaft 1 is inserted, respectively.

Available materials for the first pipe 15*a* and the second pipe 15*b* are the same as the pipe illustrated in a table of FIG. 14, alternatively, polycarbonate (PC), polybutyleneterephthalate (PBT), polyacetal or the like can be used. Those materials are reportedly small in friction, and thus, allow smooth rotation of the wings 11 around the shaft 1.

In setting up the training instrument 52, as illustrated in FIG. 12B, the shaft 1 is inserted into the stopper 3*a*, and then the stopper 3*a* is fixed to a base portion of the shaft 1. Afterward, the first pipe 15*a* and the second pipe 15*b* are attached to the shaft 1 in such a manner as to be alternately disposed. As a result, the second pipes 15*b* serve as a spacer to dispose the first pipes 15*a* apart from each other.

Subsequently, the engaging striae 16*a* of the respective first pipes 15*a* are aligned along an axial direction, and then the projection 14*c* of the wing 11 is engaged with the respective striae 16*a* of the first pipes 15*a*. Thereby, each wing 11 illustrated in FIG. 2A is attached to the respective first pipes 15*a*. In this manner, as illustrated in FIG. 12A, the three wings 11 are loaded along the axial direction of the shaft 1 and at equal intervals around the axis thereof. Afterward, the stopper 3*b* is attached to a top end of the shaft 1 and is fixed to thereby prevent the first pipe 15*a*, the second pipe 15*b* and the wings 11 from sliding out from the shaft 1.

According to the second embodiment, the wings 11 are engaged with just the pipes 15*a* which are disposed in the axial direction of the shaft 1 apart from each other. Thus, an entire contact area between the first pipes 15*a* and the shaft 1 becomes smaller in contrast with the pipe 15 of FIG. 2B. Accordingly, a resistance to a rotation of the wings 11 around the shaft 1 becomes smaller, and thus, the wings 11 rotate smoother around the shaft 1. Further, the first pipes 15*a* are attached to the shaft 1 at intervals. Thus, even in the case that the shaft 1 bends at the time of swinging the training instrument 52, a rotation of the first pipe 15*a* is not easily prevented.

Moreover, each of the wings 11 is also supported over some length by the highly rigid first pipes 15*a*, approximately similar to the training instrument 51. Therefore, it is possible to secure a sufficient strength to an air resistance with which the wings 11 are met and to smoothly change a direction of the wings in accordance with a magnitude and a direction of an air resistance. Accordingly, when training is carried out with the training instrument, muscles including the inner muscles of the arm and shoulder are subjected to approximately constant force to thereby can be developed easily and properly.

Note that in place of four first pipes 15*a* with the engaging striae 16*a* in the second embodiment, a plural number of first pipes 15*a* other than four pieces can be attached to the shaft 1.

Third Embodiment

Figure 13:
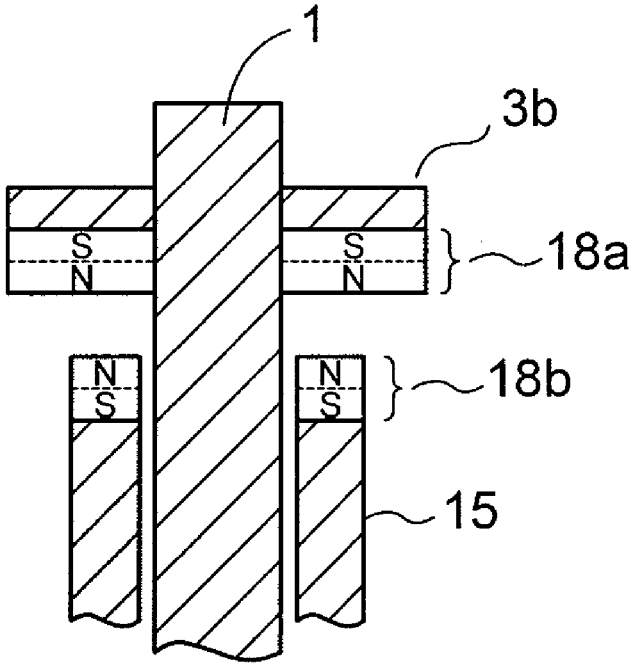
FIG. 13 is a cross-sectional view illustrating a structure attaching magnets to a top end of the pipe and the stopper in a training instrument according to a third embodiment.

FIG. 13 is a partial cross-sectional view illustrating a structure attaching magnets to a top end of a pipe and a stopper in a training instrument according to a third embodiment.

As illustrated in FIG. 13, permanent magnets 18*a*, 18*b* are attached to respective surfaces of the stopper 3*b* and the pipe 15 which are opposed to each other. The permanent magnets 18*a*, 18*b* are disposed in such a manner so that the stopper 3*b* and the pipe 15 repel each other. In this embodiment, N-poles are opposed to each other.

Incidentally, when swinging the training instrument, friction is generally caused by contact of the stopper 3*b* and the pipe 15 to prevent a smooth rotation of the first pipe 15. In contrast, through making use of the repelling force of the magnets 18*a*, 18*b* to prevent a contact of the stopper 3*b* and the pipe 15, it is possible to avoid generation of friction and to thereby smoothly rotate the pipe 15.

Further, if necessary, in addition, magnets can be attached to respective surfaces of the stopper 3*a* and the pipe 15, which are opposed to each other at the grip side, in such a manner as they repel each other.

(Examples of the Training Instrument)

Examples of the aforementioned training instrument 51, 53, 54 are illustrated in a table of FIG. 14.

The training instrument 51 of a type of FIG. 1 is represented by L, M and S in order of a larger size of the wings, the training instrument 53 of a type of FIG. 8 is represented by SS, and the training instrument 54 of a type of FIG. 9 is represented by G.

The table describes length, diameter, and material of the shaft 1, a length of the grip, length (height)×width and thickness of the wing (one piece), length, diameter and material of the pipe, entire length of the training instrument, regarding respective L, M, S, SS and G. A unit of each size is mm.

Among materials of the shaft, a plastic of nylon or the like is suitable for application to make use of a bow of the shaft, and aluminum or stainless is preferably available for L or M type in which the shaft supports larger and heavier wings.

Further, since polyacetal among materials of the shaft and the pipe has a lubricating property, it is suitable for a material of a rotating pipe, and a shaft contacting the pipe.

Next, description is performed for an application and a training method suitable for respective types.

The training instrument 51, which is represented by (L) in the table 1 and is larger and heavier, is suitable for training of batting or golf swing. In the training, a practice swing is performed by holding the training instrument 51 in both hands in place of a bat or a club.

Further, the training instrument 51, which is represented by (M) in the table 1 and is medium in size and weight, is suitable for training for pitching and batting in baseball, or training for badminton and tennis. In the training, a practice swing is performed by holding the training instrument 51 in a hand in place of a ball or racket, or in both hand in place of bat.

The training instrument 51, which is represented by (S) in the table 1 and is smaller in size and lighter in weight, is suitable for training for pitching and batting in baseball, or training for badminton and tennis, alternatively, it can also be used for rehabilitation in medical treatment. In the training for sports, the training is performed similar to the (M) type. On the other hand, when used for rehabilitation, at least one arm is swung back and forth and around while holding the training instrument 51 in one hand or in both hands.

The training instrument 53, which is represented by (SS) in the table 1, is much smaller in size and lighter in weight than the (S) type. Thus, it is preferable to make a choice depending on an application and a training method in accordance with the size and weight. For example, regarding the application, it is suitable for rehabilitation in medical treatment, especially, rehabilitation for children and elderly persons who cannot hold an instrument that is too heavy for them. In the rehabilitation setting, one training instruments 51 can be held in each hand, allowing both arms to be swung back and forth and around.

For the training instrument 54 which is represented by (G) in the table 1, the same application and training method factors as with the training instrument 51 can be considered when deciding whether to use the training instrument 54. In this case, wings 21 are formed small and attached at a position closer to a top end of the shaft 1 so that the training instrument 54 is made light as a whole and weight center thereof is set closer to the top end of the shaft 1. Therefore, it is easy to swing the training instrument 54, and a force to pull an arm becomes larger by centrifugal force. Thus, muscles including the inner muscles of the arm and shoulder are effectively built up.

Fourth Embodiment

Referring to FIG. 15 to FIG. 18, a description is provided for a training instrument 55 according to the fourth embodiment of the present invention. The training instrument 55 has a structure that is capable of folding wings 34*a* to 34*c* which are attached to the shaft 1.

Figure 15:
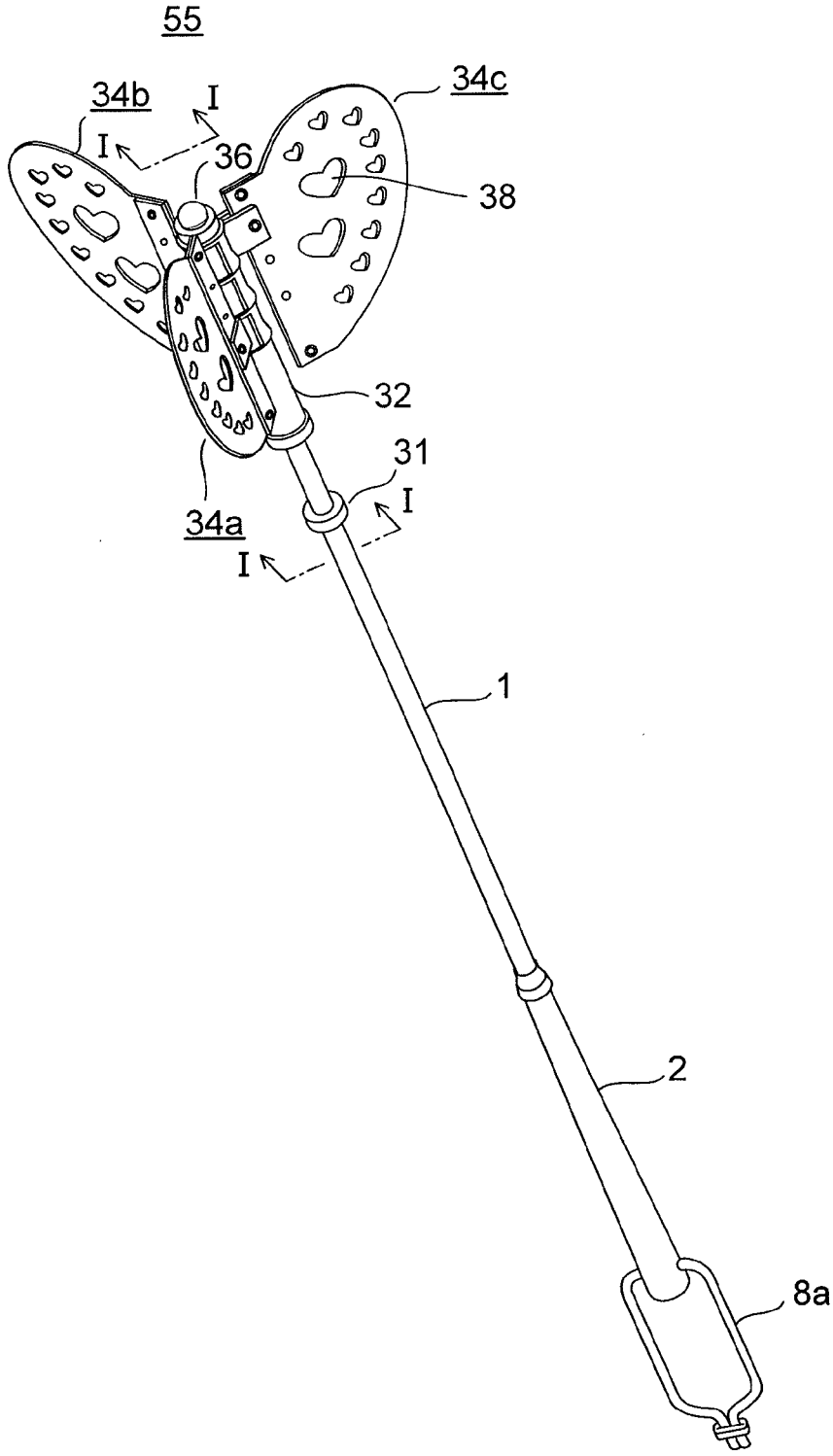
FIG. 15 is a perspective view illustrating a training instrument according to a fourth embodiment.

The whole structure of the training instrument 55 is illustrated in FIG. 15. In the training instrument 55, three wings 34*a* to 34*c* are disposed radially and at equal intervals around the shaft 1, and are attached in such a manner as the wings 34*a* to 34*c* can rotate around the shaft 1. Note that a symbol 8*a* represents a strap, and 38 represents holes in the wings 34*a* to 34*c* and thereby adjust an air resistance with which the wings 34*a* to 34*c* are met. The materials described on the table in FIG. 14 are available for the shaft 1, the grip 2 and the wings 34*a* to 34*c*.

In case of folding the three wings, a second stopper 32 is first moved down towards a third stopper 31 along the shaft 1, and then, the two wings 34*a*, 34*b* of the lower side are moved downward to the second stopper 32 along the shaft 1. Next, the wing 34*b* is rotated in a left direction and the wing 34*a* is rotated in a right direction to fold the wings 34*a*, 34*b* so that the wings 34*a* and 34*b* are stacked, one below and one above the wing 34*c*.

Figure 16:
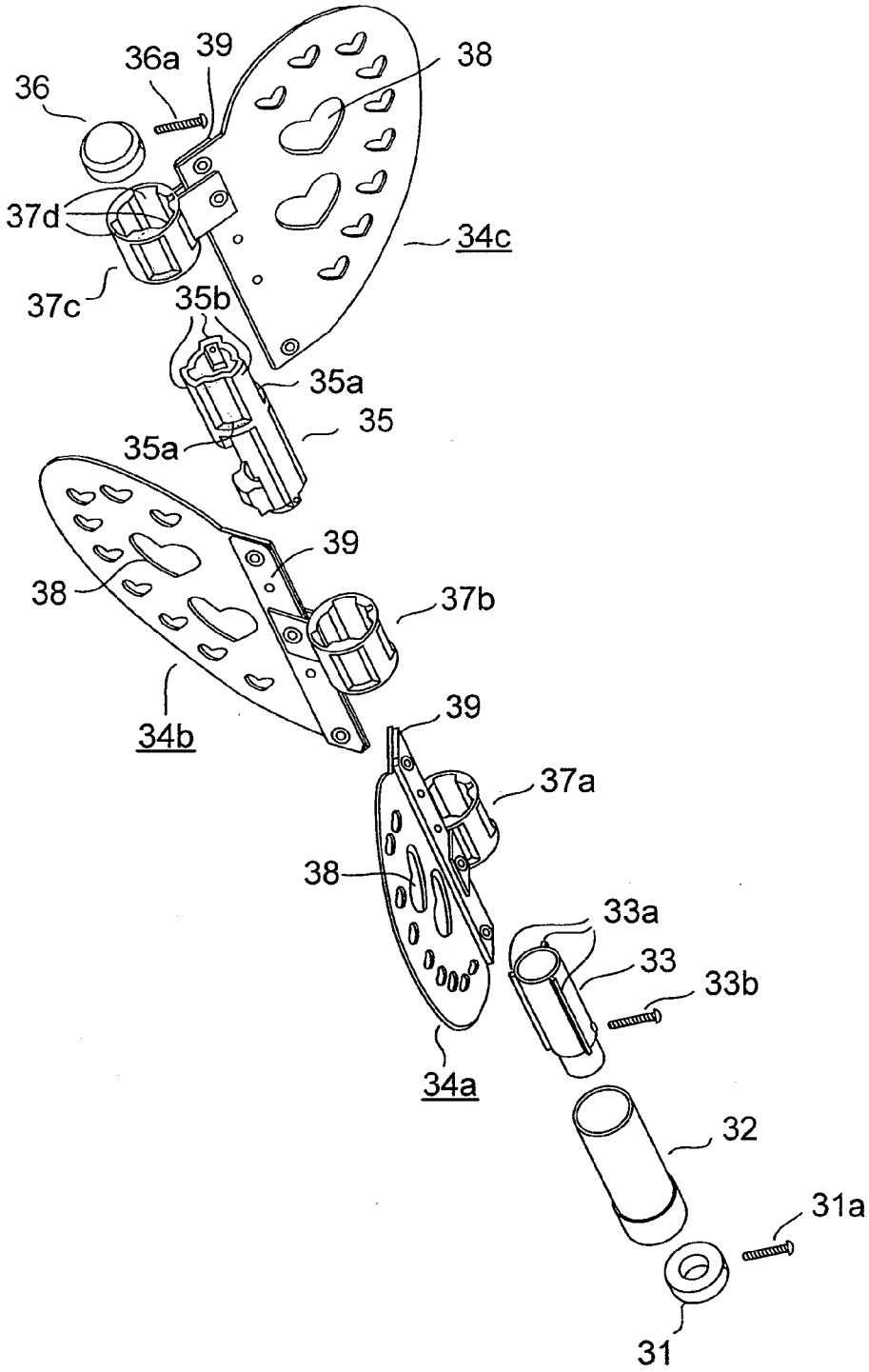
FIG. 16 is a perspective view illustrating parts except for the wings of the training instrument according to the fourth embodiment.
Figure 17A:
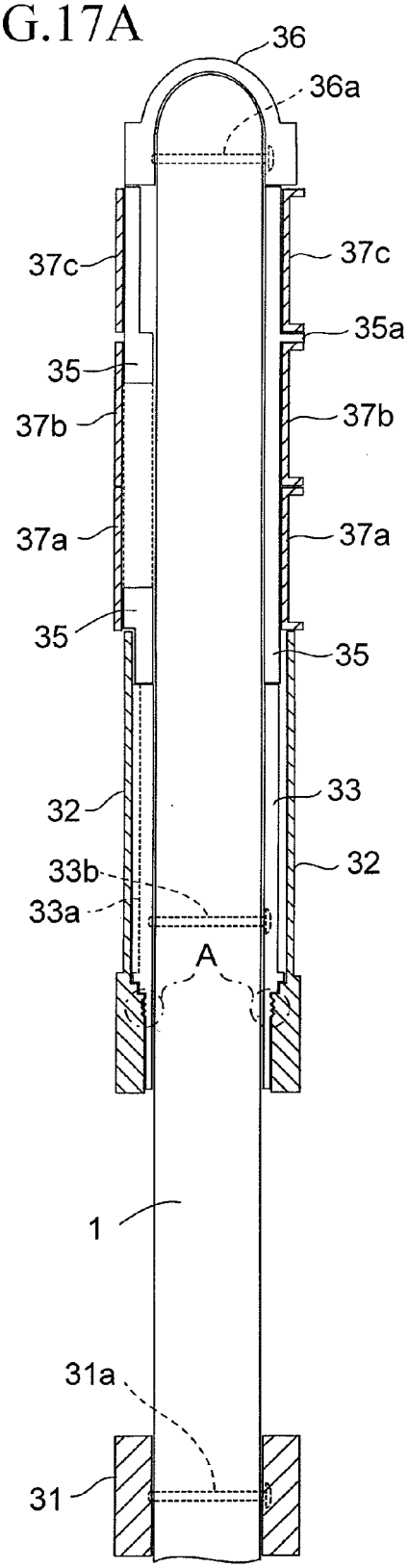
FIG. 17A is a cross-sectional view taken along a line I-I of FIG. 15.
Figure 17B:
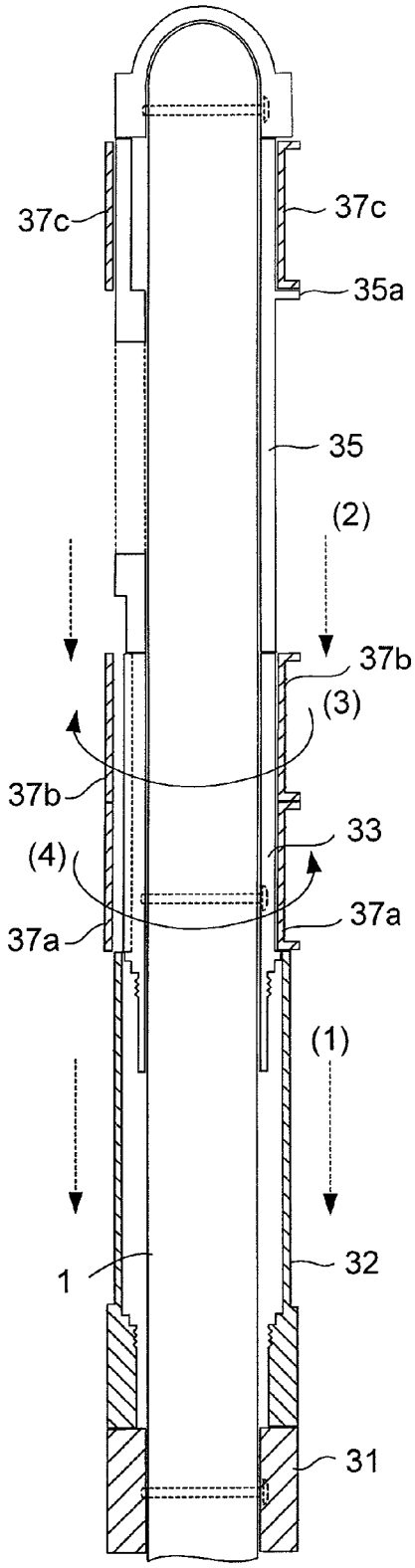
FIG. 17B is a cross-sectional view sliding two wings of a lower side downward.

Next, referring to FIGS. 16, 17A, and 17B, a description is provided in more detail for a structure that is capable of folding the three wings 34 to 34*c* which are attached to the shaft 1. In FIG. 16, the shaft 1 is omitted for convenience so as to be able to easily understand the structure. The wing 34*c* is attached to a tubular wing holder 37*c* with grommets. Note that a symbol 39 is a plate for reinforcing attachment between the wing 34*c* and the wing holder 37*c*. Also the cases of the wing holders 37*a*, 37*b* are similar to the case of the wing holder 37*c*, thus, descriptions are omitted.

The wing holders 37*a* to 37*c* are attached to a holder-attaching pipe 35 rotating around the shaft 1. The wing holder 37*c* at an uppermost position on the holder-attaching pipe 35 is attached to an upper attaching position of the wing 34*c*, the wing holder 37*b* at a middle position is attached to a middle attaching position of the wing 34*b*, and the wing holder 37*a* at a lowermost position is attached to a lower attaching position of the wing 34*a*. Note that available materials of the pipe 35 are those represented in the table of FIG. 14.

In order to prevent the wing holder 37*c* from rotating around the holder-attaching pipe 35, the wing holder 37*c* is fixed to the pipe 35. Three projections 35*b* are formed along an axial direction on a surface of the holder-attaching pipe 35, and in accordance with the three projections 35*b*, grooves 37*d* with which the projections 35*b* are engaged are formed on an inner wall surface of the wing holder 37*c*. The wing holders 37*a*, 37*b* also can be fixed to the holder-attaching pipe 35 in the same way as the wing holder 37*c* is fixed. In this case, the three wing holders 37*a* to 37*c* are attached in such a manner so that the wings 34*a* to 34*c* are disposed at equally-spaced intervals around the pipe 35.

Further, the holder-attaching pipe 35 has a movement preventing portion 35*a* projected on a surface thereof to thereby stop downward movement of the uppermost wing holder 37*c* at the movement preventing portion 35*a*. Note that even in such a structure, the two wing holders 37*a*, 37*b* of lower side can move downward. On the other hand, to limit upward movement of the uppermost wing holder 37*c*, an upper stopper (a fourth stopper) 36 is fixed to the shaft 1 with a screw 36*a* (referring to FIG. 17A). Accordingly, a position of the uppermost wing holder 37*c* is maintained between the upper stopper 36 and the lower movement preventing portion 35*a* (referring to FIG. 17B).

To limit downward movement of the holder-attaching pipe 35, a tubular stopper (a first stopper) 33 is fixed to the shaft 1 underneath the pipe 35 with a screw 33*b* (referring to FIG. 17A).

Further, to prevent and enable downward movement of the wing holders 37*a* and 37*b*, a stopper (a second stopper) 32 is attached over an outer surface of the stopper 33. An inner diameter of the stopper 32 is larger than an outer diameter of the stopper 33 including the projection 33*a*. Therefore, the stopper 32 can move up and down over the outer surface of the stopper 33. Note that the projection 33*a* is formed in such a manner so that the stopper 32 can move up and down smoothly.

Moreover, to engage the stopper 32 with the stopper 33 and thus fix the stopper 32 at the A-portion, a screw is attached on an inner surface of a lower end of the stopper 32, and a counter screw is attached on an outer surface of a lower end of the stopper 33. On the other hand, to limit downward movement of the stopper 32, a stopper (a third stopper) 31 is fixed to the shaft 1 with a screw 31*a*.

Figure 18:
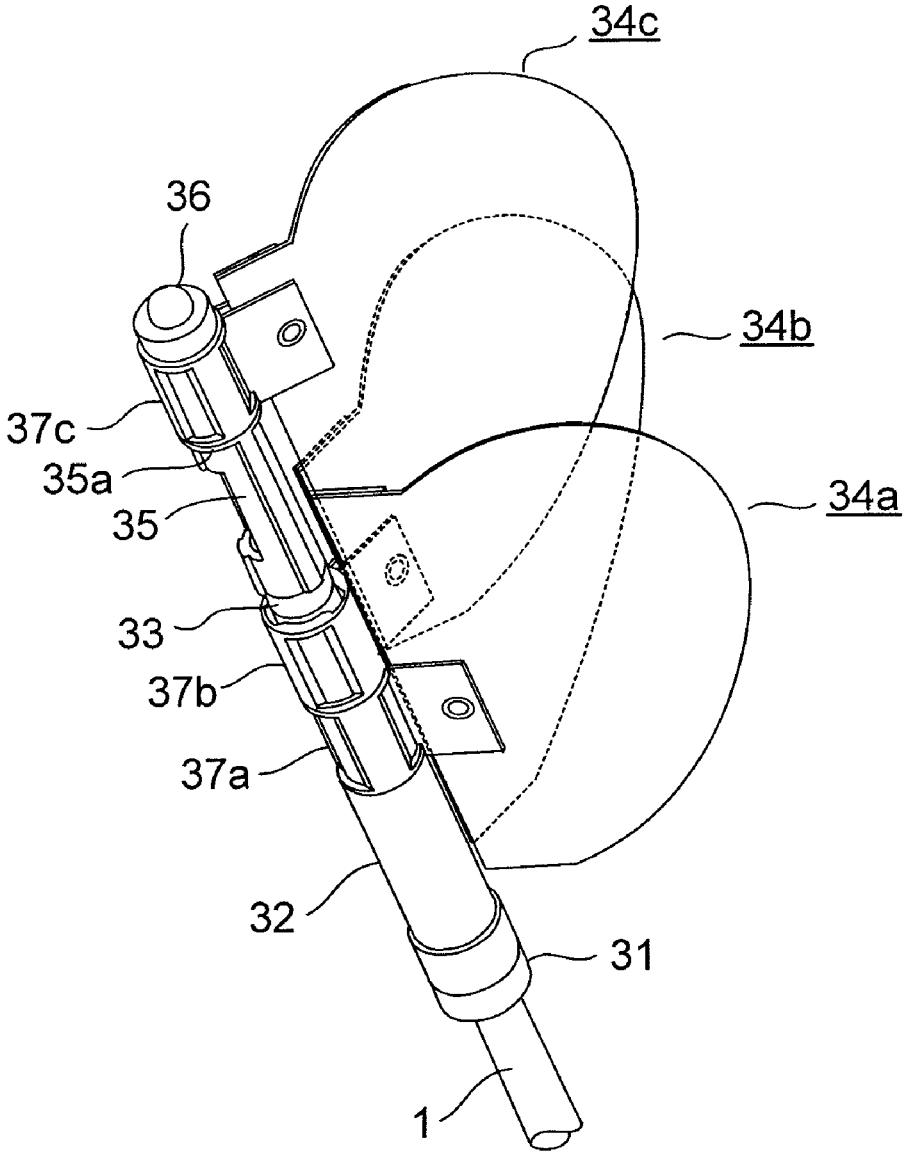
FIG. 18 is a perspective view illustrating a state after folding the wings of the training instrument of FIG. 15.

Next, a description is provided in detail for a folding method of the three wings referring to FIG. 17B and FIG. 18.

In the first stage, as illustrated in FIG. 17B, the stopper 32 which is fixed at A-portion is released from the engagement, and then, the stopper 32 is moved downward (as represented by a symbol (1) in FIG. 17B) to the stopper 31. It is followed by moving the wing holders 37*a*, 37*b* downward (as represented by a symbol (2) in FIG. 17B) to the stopper 32. Afterward, the wing holder 37*b* is rotated in a left direction (as represented by a symbol (3) in FIG. 17B), and the wing holder 37*a* is rotated in a right direction (as represented by a symbol (4) in FIG. 17B) to fold two wings 34*a*, 34*b* so that the wings 34*a*, 34*b* are stacked one above and one below the wing 34*c* as illustrated in FIG. 18. In this manner, the three wings can be folded. Note that holes 38 of the wing such as being illustrated in FIGS. 15, 16 are omitted in FIG. 18.

As described above, since it is capable of folding the wings thereof, the training instrument 55 according to the fourth embodiment is convenient for shipping or carrying.

In this embodiment, since the wings are supported over some length by the highly rigid pipe almost similar to the training instrument 51, it is possible to secure a sufficient strength to an air resistance with which the wings are met, and to smoothly change a direction of the wings in accordance with a magnitude and a direction of the air resistance. Accordingly, when training is carried out using the training instrument 55, the arm and shoulder of the trainee are loaded with approximately constant burden during swinging, and thus, it is possible to easily and properly develop muscles including the inner muscles of the arm and shoulder for sports.

Modified Example of Fourth Embodiment

Figure 19:
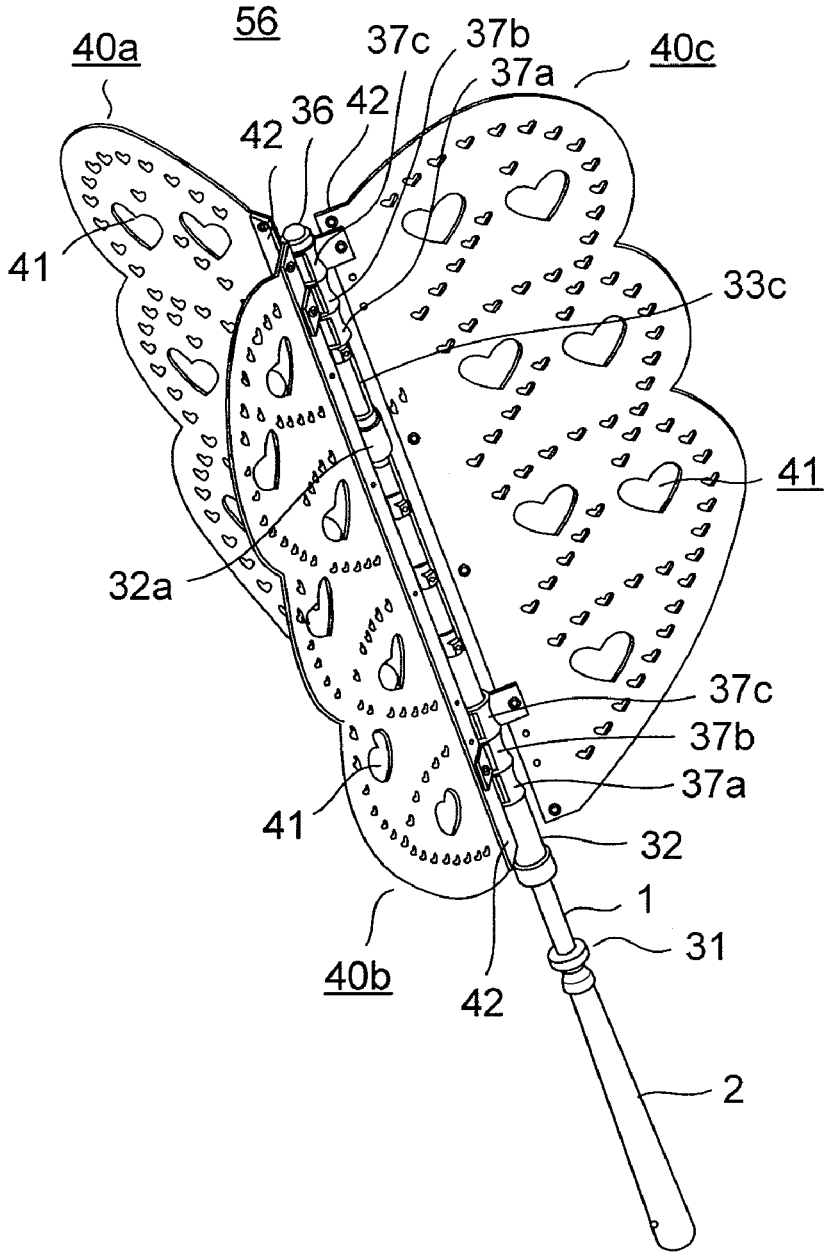
FIG. 19 is a perspective view illustrating a modified example of the training instrument according to the fourth embodiment.
Figure 20:
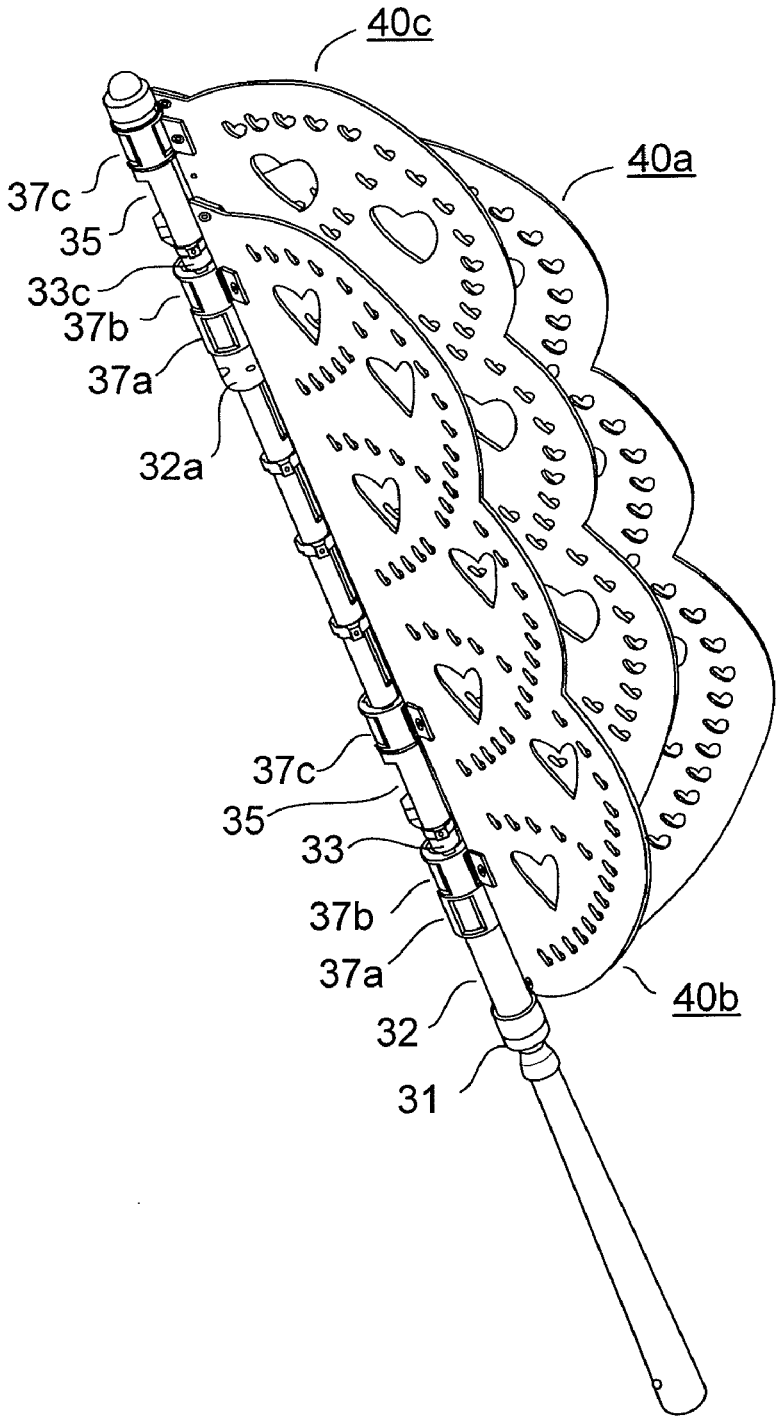
FIG. 20 is a perspective view illustrating a state after folding the wings of the training instrument of FIG. 19.

FIG. 19 is a perspective view illustrating a training instrument 56 according to the modified example of the fourth embodiment. FIG. 20 is a perspective view illustrating a state after folding the wings.

In this training instrument 56, because of longer wings 40*a* to 40*c*, three wing holders 37*a* to 37*c* are attached to respective upper and lower portions of the wing per one wing. In accordance with it, the holder-attaching pipes 35, the second stoppers 32*a*, 32, and the first stoppers 33*c*, 33 are attached around respective upper and lower wing holder-attaching portions.

Note that a symbol 41 represents holes in the wings 40*a* to 40*c* and thereby adjust the air resistance with which the wings are met, and 42 represents each of plates which reinforce the attachments between the wing holders 37*a* to 37*c* and the wings 40*a* to 40*c*, respectively.

In case of using the training instrument 56 for training, as illustrated in FIG. 19, the wing holders 37*a* to 37*c* are attached to the pipes 35 at the respective upper and lower portions of the wings 40*a* to 40*c* in such a manner as the wings 40*a* to 40*c* are disposed radially and at regular intervals around the shaft 1. The second stopper 32 is clamped to the first stopper 33 with a screw to thereby allow inserting the pipe 35 into the wings 37*a*, 37*b*.

On the other hand, in case of folding the wings 40*a* to 40*c*, as illustrated in FIG. 20, the stopper 32 is moved downward to the stopper 31. It is followed by moving the wing holders 37*a*, 37*b* of a lower side downward to the stopper 32. In accordance with this, the wing holders 37*a*, 37*b* of an upper side are also moved downward to the second stopper 32*a*. Afterward, similar to FIG. 17B, the wings 40*a*, 40*b* are moved in left and right directions respectively to fold the wings 40*a*, 40*b* in such a manner as the wings 40*a*, 40*b* are stacked one above and one below the wing 40*c* as illustrated in FIG. 20.

The training instrument 56 of the modified embodiment also is convenient for shipping or carrying because it is capable of folding the wings 40*a* to 40*c* in a state of attaching them to the shaft 1.

Further, since the wings 40*a* to 40*c* are attached to only the pipes 35 which are disposed at intervals in an axial direction similar to the second embodiment, it has the same advantage as the second embodiment.

According to the training instrument of the invention, the projection of the wing is engaged with the striae extending in an axial direction of the pipe so that the wing is anchored to the striae. Thus, when the wings are met with an air resistance by swinging the training instrument, its air resistance is distributed evenly along with the pipe. In addition, the pipe has a highly rigid property. Therefore, the pipe can be prevented from distorting to secure a smooth rotation of the wings.

Accordingly, a direction of the wings can be changed smoothly depending on the loading air resistance as illustrated in FIG. 5 to FIG. 7 for examples, and thus, the trainee can be prevented from being loaded on his shoulder with an excessive burden.

Although the invention is described in detail by the above embodiments, a scope of the invention is not limited to the examples described specifically and includes modifications of the embodiments without departing from the spirit and scope of the present invention.

For example, the above embodiments describe the examples where the wings 11, 21, 34*a* to 34*c*, 40*a* to 40*c* rotate 360 degrees around the shaft 1. Alternatively, rotation of the wings can be limited within a predetermined range of angle.

Further, in FIG. 4B, the stoppers 3*a*, 3*b* are attached to the shaft 1 by adjusting the inner diameter of the stoppers 3*a*, 3*b* with the screw. Alternatively, they can be directly attached to the shaft 1 with a screw. Further, there is the following option to fix the stoppers to the shaft. That is to in advance form through-holes which pierce both the stopper and the shaft all at once from a side direction in a state of inserting the shaft in the stopper and then insert a pin in the through-holes. In this case, the pin can adopt a structure similar to a hairpin, such that the pin does not come out from the shaft by making use of a spring.

Moreover, the invention is not limited to the structure such that the training instruments 51, 51*a*, 51*b*, 53, 54, 55, 56 have three wings 11, 21, 34*a* to 34*c*, 40*a* to 40*c*. There is an option of attaching wings of the appropriate number of two or more pieces.

Further, the invention is not limited to the structure such that the holes 13, 23, 38, 41 are formed in the specific number and areas in the wings 11, 21, 34*a* to 34*c*, 40*a* to 40*c*. To adjust an air resistance with which the wings 11, 21, 34*a* to 34*c*, 40*a* to 40*c* are met, there is an option of appropriately adjusting the specific number and areas of holes 13, 23, 38, 41. In addition, an available shape of holes 13, 23, 38, 41 is not limited to the heart-like shape and can be an arbitrary shape.

Moreover, in FIGS. 1, 8, 15 and 16, the shaft 1 is directly inserted in the pipe 15, 25, 35. Alternatively, ball bearings or the like can be put between an inner surface of the pipe 15, 25, 35 and outer surface of the shaft 1, 1*a* so that the pipe 15, 25, 35 smoothly rotates around the shaft 1, 1*a*. For example, an engaging groove may be formed along a circumference of an inner surface of the pipe 15, 25, or an outer surface of the shaft 1, 1*a* to place ball bearings in the engaging groove.

Further, in the fourth embodiment and the modified example, the wings are folded by pulling the wing holders 37*a*, 37*b* of a lower side down without pulling the uppermost wing 37*c* down.

Alternatively, the wings may be folded by pulling all of the wings 37*a* to 37*c* down.

Supplementary notes are summarized as follows for the invention described in the embodiments.

A training instrument comprising:

a rigid pipe being provided with engaging striae extending in an axial direction, and having a predetermined inner diameter;

leaf-shaped wings each of which is provided with a projection of a cross-sectional shape in accordance with each of the engaging striae;

a shaft having an outer diameter smaller than an inner diameter of the pipe and being inserted in the pipe;

a stopper being attached to an end of the shaft; and a grip being attached to the shaft.

The three engaging striae are formed at equally-spaced intervals around the pipe on a surface of the pipe, and the wings are attached to the three striae, respectively.

Each of the engaging striae has a cross-sectional shape being wider in a lower side than in an upper side.

The engaging striae are formed in an integrated manner with the pipe.

Each of the wings is provided with a plurality of holes which adjust an air resistance.

A material of the pipe is any one of polyacetal, polypropylene or nylon.

A material of the shaft is any one of polyacetal, polypropylene and nylon.

A material of the shaft is any one of aluminum and stainless steel.

The training instrument is comprised of a plurality of the pipes with the engaging striae and at least one pipe without any engaging striae, wherein the pipes with the engaging striae are attached to the shaft by putting the pipe without any engaging striae between the respective pipes with the engaging striae.

The three engaging striae are formed at equally-spaced intervals around the respective pipes on a surface of the respective pipes, and the wings are attached to the three striae of the respective pipes, respectively.

Each of the engaging striae has a cross-sectional shape being wider in a lower side than in an upper side.

The engaging striae are formed in an integrated manner with each of the pipes.

Each of the wings is provided with a plurality of holes which adjust an air resistance.

A material of each of the pipes is any one of polyacetal, polypropylene or nylon.

A material of the shaft is any one of polyacetal, polypropylene and nylon.

A material of the shaft is any one of aluminum and stainless steel.

A training instrument comprising:

a shaft;

a grip being attached to the shaft;

a rigid holder-attaching pipe in which the shaft is inserted;

a first, second, and third wing holders having tubular shapes, in which the holder-attaching pipe is inserted;

leaf-shaped wings being attached to the first, second, and third wing holders, respectively;

a first stopper of a tubular shape being fixed to the shaft to prevent the holder-attaching pipe from moving to the grip side;

a second stopper of a tubular shape, in which the shaft is inserted to be concentric on the first stopper and being capable of being attached to and being detached from the first stopper;

a third stopper of a tubular shape being fixed to the shaft and preventing the second stopper from moving to the grip side; and a fourth stopper being attached to an end of the shaft, wherein when the second stopper is fixed to the first stopper, the first and second wing holders are prevented from moving to the grip side, and when the second stopper is released from the first stopper, the second stopper is moved to the third stopper, and then, the first and second wing holders are moved from the holder-attaching pipe on a surface of the first stopper, followed by folding the wings.

The holder-attaching pipe is provided with a moving preventing portion which prevents the third wing holder from moving to the first stopper side when the second stopper is released from the first stopper.

Each of the wings is provided with a plurality of holes which adjust an air resistance.

A material of the holder-attaching pipe is any one of polyacetal, polypropylene or nylon.

A material of the shaft is any one of polyacetal, polypropylene and nylon.

A material of the shaft is any one of aluminum and stainless steel.

What is claimed is:

1. A training instrument, comprising:

a shaft;

a grip being attached to the shaft;

a rigid holder-attaching pipe in which the shaft is inserted;

a first, second, and third wing holders having tubular shapes, in which the holder-attaching pipe is inserted;

leaf-shaped wings being attached to the first, second, and third wing holders, respectively;

a first stopper of a tubular shape being fixed to the shaft to prevent the holder-attaching pipe from moving to the grip side;

a second stopper of a tubular shape in which the shaft is inserted to be concentric on the first stopper and attachable to and detachable from the first stopper;

a third stopper of a tubular shape being fixed to the shaft and preventing the second stopper from moving to the grip side; and a fourth stopper being attached to an end of the shaft, wherein when the second stopper is fixed to the first stopper, the first and second wing holders are prevented from moving to the grip side, and when the second stopper is released from the first stopper, the second stopper is moved to the third stopper, and then, the first and second wing holders are moved from the holder-attaching pipe on a surface of the first stopper, followed by folding the wings.

2. The training instrument according to claim 1, wherein the holder-attaching pipe includes a moving preventing portion which prevents the third wing holder from moving to the first stopper side when the second stopper is released from the first stopper.

3. The training instrument according to claim 1, wherein each of the wings includes a plurality of holes which adjust an air resistance.

4. The training instrument according to claim 3, wherein patterns of the hole dispositions in the leaf-shaped wings are the same as each other.

5. The training instrument according to claim 1, wherein the shapes of the wings are the same as each other.

6. The training instrument according to claim 1, wherein positions in the leaf-shaped wings for attaching the leaf-shaped wings to the first, second and third wing holders are different from each other.

7. The training instrument according to claim 1, wherein each of the wings has an edge along an entire length thereof, and the edge has multiple curve ends.

8. The training instrument according to claim 1, wherein a material of the holder-attaching pipe is any one of polyacetal, polypropylene and nylon.

9. The training instrument according to claim 1, wherein a material of the shaft is any one of polyacetal, polypropylene and nylon.

10. The training instrument according to claim 1, wherein a material of the shaft is any one of aluminum and stainless steel.

* * * * *